US005377739A

United States Patent [19]

Kirby

[11] Patent Number: 5,377,739

[45] Date of Patent: Jan. 3, 1995

[54] SECURITY DEVICE FOR CONTROLLING WINDOW BLINDS

[76] Inventor: Terry Kirby, 524 N. Manus Dr., Dallas, Tex. 75224

[21] Appl. No.: 172,182

[22] Filed: Dec. 23, 1993

[51] Int. Cl.[6] ..... E05F 15/00

[52] U.S. Cl. ..... 160/188; 160/166.1; 160/178.1

[58] Field of Search ..... 160/1, 2, 7, 115, 188, 160/168.1, 176.1, 178.1, 166.1

[56] References Cited

U.S. PATENT DOCUMENTS 4,173,721 11/1979 Louis ..... 160/2 X
4,664,169 5/1987 Osaka et al. ..... 160/2 X

FOREIGN PATENT DOCUMENTS 566981 12/1932 Germany ..... 160/2
169997 7/1991 Japan ..... 160/1

*Primary Examiner*—Blair M. Johnson

[57] ABSTRACT

A new and improved security device for controlling window blinds by automatically periodically lifting and lowering a single slat of a conventional venetian blind or mini blind set to simulate human activity to an observer located outside the window. The security device for controlling window blinds comprises a motor-driven pull-cord clipedly connected to a slat of the window blind set, a motor having a motor controller whereby the frequency and duration of the slat movement is established, and a fairlead wherethrough the pull-cord is routed from the window blind slat to the drive motor.

5 Claims, 3 Drawing Sheets

SECURITY DEVICE FOR CONTROLLING WINDOW BLINDS

BACKGROUND OF THE INVENTION

1. Field of the Invention

The present invention relates to window blind controllers and more particularly pertains to security devices for controlling window blinds which may be adapted for automatically periodically lifting and lowering a single slat of a conventional venetian blind or mini blind set to simulate human activity to an observer located outside the window.

2. Description of the Prior Art

The use of window blind controllers is known in the prior art. More specifically, window blind controllers heretofore devised and utilized for the purpose of lifting and lowering blinds are known to consist basically of familiar, expected and obvious structural configurations, notwithstanding the myriad of designs encompassed by the crowded prior art which have been developed for the fulfillment of countless objectives and requirements.

The present invention is directed to improving devices for automatically periodically lifting and lowering a single slat of a conventional venetian blind or mini blind set to simulate human activity to an observer located outside the window in a manner which is safe, secure, economical and aesthetically pleasing.

For example, U.S. Pat. No. 5,031,681 to Dodich discloses a tilt control for window blinds and method of manufacture which includes a tilt control rod rotatably mounted in a channel having a nonrotatable stop bracket. The tilt control rod has a pair of tilt control discs nonrotatably mounted thereon, the tilt control discs having a stop surface for engaging the stop bracket. A pair of the discs are disposed with the respective stop surfaces facing one another but angularly separated to define the range of rotational movement of the tilt control rod. The invention described is unrelated to the function of automatically moving a single window blind slat such that an outside observer might believe their own activity was being watched from inside.

The prior art also discloses window blind control apparatus as shown in U.S. Pat. No. 4,979,550 to Long et al. which consists of an apparatus for selective control in the opening and closing of an associated window blind arrangement.

U.S. Pat. No. 5,038,087 to Archer et al. shows an apparatus for controlling a D.C. motor used in the lifting and lowering operation of a window blind or an awning including a motor rotor pulse generator and counter means for stopping the motor at the end positions of the blind or awning.

In U.S. Pat. No. 5,092,382 by Flückiger, apparatus which facilitates the raising and lowering of a pull-up band for a window blind is described. The invention includes an axially rotatable winding shaft having at least one winding roller disposed thereon, the winding roller being adapted to extend and retract a pull-up band wound thereon responsive to a drive mechanism which transfers motion from the winding shaft to the winding roller.

U.S. Pat. No. 5,175,478 to Chen discloses an electrically operated driving shaft control device for a window blind which includes a driving means having a shaft with a guiding roller. A rope encircles the guiding roller and connects to a blind. The invention also has means for breaking an electric circuit when a predetermined tension of the rope is reached during rotation of the driving shaft.

Lastly, U.S. Pat. No. 4,956,588 to Ming relates to an attachable hand-operated/automatic dual usage venetian blind controller to set the blades of such a venetian blind together at any angle or to draw up the blades together to one side of the window by means of infrared remote control so as to regulate the light and air passing through. All five of the inventions disclosed above deal with opening, closing, or drawing up a window blind set or awning.

None of the disclosures teaches a way for automatically moving a window blind slat such that an outside observer might believe their own activity was being watched from inside whereby lessening the likelihood of a break-in.

In this respect, the security device for controlling window blinds according to the present invention substantially departs from the conventional concepts and designs of the prior art, and in so doing provides an apparatus primarily developed for the purpose of automatically periodically lifting and lowering a single slat of a conventional venetian blind or mini blind set to simulate human activity to an observer located outside the window.

Therefore, it can be appreciated that there exists a continuing need for new and improved window blind controllers which can be used for automatically periodically lifting and lowering a single slat of a conventional venetian blind or mini blind set to simulate human activity to an observer located outside the window. In this regard, the present invention substantially fulfills this need.

As illustrated by the background art, efforts are continuously being made in an attempt to develop devices for controlling window blinds. No prior effort, however, provides the benefits attendant with the present invention. Additionally, the prior patents and commercial techniques do not suggest the present inventive combination of component elements arranged and configured as disclosed and claimed herein.

The present invention achieves its intended purposes, objects, and advantages through a new, useful and unobvious combination of method steps and component elements, with the use of a minimum number of functioning parts, at a reasonable cost to manufacture, and by employing only readily available materials.

SUMMARY OF THE INVENTION

In view of the foregoing disadvantages inherent in the known types of window blind controllers now present in the prior art, the present invention provides an improved window blind controller construction wherein the same can be utilized for automatically periodically lifting and lowering a single slat of a conventional venetian blind or mini blind set to simulate human activity to an observer located outside the window. As such, the general purpose of the present invention, which will be described subsequently in greater detail, is to provide a new and improved security device for controlling window blinds apparatus and method which has all the advantages of the prior art security device for controlling window blinds and none of the disadvantages.

The invention is defined by the appended claims with the specific embodiment shown in the attached drawings. For the purpose of summarizing the invention, the invention may be incorporated into a new and improved security device for controlling window blinds by automatically periodically lifting and lowering a single slat of a conventional venetian blind or mini blind set to simulate human activity to an observer located outside the window. The security device for controlling window blinds comprises clip means of transparent rigid material, such as plastic, removedly hookedly connected to the inside of a slat in a tilted-down closed window blind set, the clip means having an attachment point. The security device also includes fairlead means, such as a plurality of screw-eyes, fixedly disposed across the top of the window blind. Also included is controller means for periodically motivating the blind slat. The controller means comprises housing means having a plurality of apertures extending from the inside to the outside of the housing. The housing means is fixedly mounted to a wall or floor adjacent to the window blind. The controller means further has electrical energy source means, such as a battery, functionally removedly mounted inside the housing means and timer means, wherefrom an electrical control signal is emitted. The timer control signal has a fixed period and a fixed duration. The timer means is fixedly mounted inside the housing means and is operationally electrically connected to the electrical energy source means. The controller means additionally incorporates an electrical motor fixedly mounted inside the housing means. The electrical motor has a motor shaft extending therefrom. The motor shaft has drive coupling means, such as a spur gear, fixedly coaxially coupled thereto. The electrical motor is functionally electrically connected to the energy source means wherefrom motivating power is derived. The electrical motor is also functionally electrically connected to the timer means wherefrom control signals are derived whereby the motor is periodically started and stopped, the motor having a mechanical response to the timer control signal such that a single complete revolution of the motor shaft occurs during the duration of one period of the control signal. The controller means moreover includes actuator means whereby rotational motion of the motor shaft is converted to oscillatory linear motion for lifting and lowering the blind slat. The actuator means comprises a drive shaft journalled within the housing means, the drive shaft being parallel with the motor shaft. The drive shaft has drive coupling means, such as a pinion, fixedly coaxially coupled thereto in cooperative relationship with the drive coupling means of the motor shaft. The drive shaft further has a swivel coupling rotationally eccentrically connected thereto whereby rotation of the drive shaft causes the swivel coupling to orbit the drive shaft whereby the swivel coupling describes a relatively large circular excursion as compared to the excursion of a corresponding point on the surface of the drive shaft. The security device additionally includes a cord fixedly connected at one end to the attachment point of the clip means. The cord extends generally vertically upwardly through the fairlead means, then horizontally across the top of the window. The cord further extends generally vertically downwardly from the fairlead means, through an aperture of the housing means, and is fixedly connected at the free end to the eccentrically operating swivel coupling whereby a linear pulling then relaxing oscillatory motion is imparted to the cord as the swivel coupling revolves around the drive shaft. The linear oscillatory motion of the cord is transferred to the clip means, and thence to the blind slat, whereby the slat is raised then lowered at a speed determined by the duration of the timer control signal. The repetition rate of each raising and lowering action is determined by the period of the timer control signal.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. In as much as the foregoing has outlined rather broadly the more pertinent and important features of the present invention in order that the detailed description of the invention that follows may be better understood so that the present contribution to the art can be more fully appreciated. Additional features of the invention will be described hereinafter which form the subject of the claims of the invention. It should be appreciated by those skilled in the art that the conception and the disclosed specific methods and structures may be readily utilized as a basis for modifying or designing other structures for carrying out the same purposes of the present invention. It should be realized by those skilled in the art that such equivalent methods and structures do not depart from the spirit and scope of the invention as set forth in the appended claims.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

Therefore, it is an object of the present invention to provide a new and improved security device for controlling window blinds by automatically periodically lifting and lowering a single slat of a conventional venetian blind or mini blind set to simulate human activity to an observer located outside the window.

It is another object of the present invention to provide a new and improved security device for controlling window blinds which may be easily and efficiently manufactured and marketed.

It is a further object of the present invention to provide a new and improved security device for controlling window blinds which is of a durable and reliable construction.

An even further object of the present invention is to provide a new and improved security device for controlling window blinds which is susceptible of a low cost of manufacture with regard to both materials and labor, and which accordingly is then susceptible of low prices of sale to the consuming public, thereby making such security device for controlling window blinds economically available to the buying public.

Still yet another object of the present invention is to provide a new and improved security device for controlling window blinds which provides in the apparatuses and methods of the prior art some of the advantages thereof, while simultaneously overcoming some of the disadvantages normally associated therewith.

Still yet another object of the present invention is to provide a new and improved security device for controlling window blinds which is portable and easily installable, making it useful for hotel or motel guests.

Yet another object of the present invention is to provide a new and improved security device for controlling window blinds that is self-contained as to source of power, thereby being effective during power blackouts.

Even still another object of the present invention is to provide a new and improved security device for controlling window blinds that is universal in design so as to fit a wide variety of different makes and models of venetian blind sets and mini blind sets.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention. The foregoing has outlined some of the more pertinent objects of this invention. These objects should be construed to be merely illustrative of some of the more prominent features and applications of the present invention. Many other beneficial results can be attained by applying the disclosed invention in a different manner or by modifying the invention within the scope of the disclosure. Accordingly, other objects and a fuller understanding of the invention may be had by referring to the summary of the invention and the detailed description of the preferred embodiment in addition to the scope of the invention defined by the claims taken in conjunction with the accompanying drawings.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
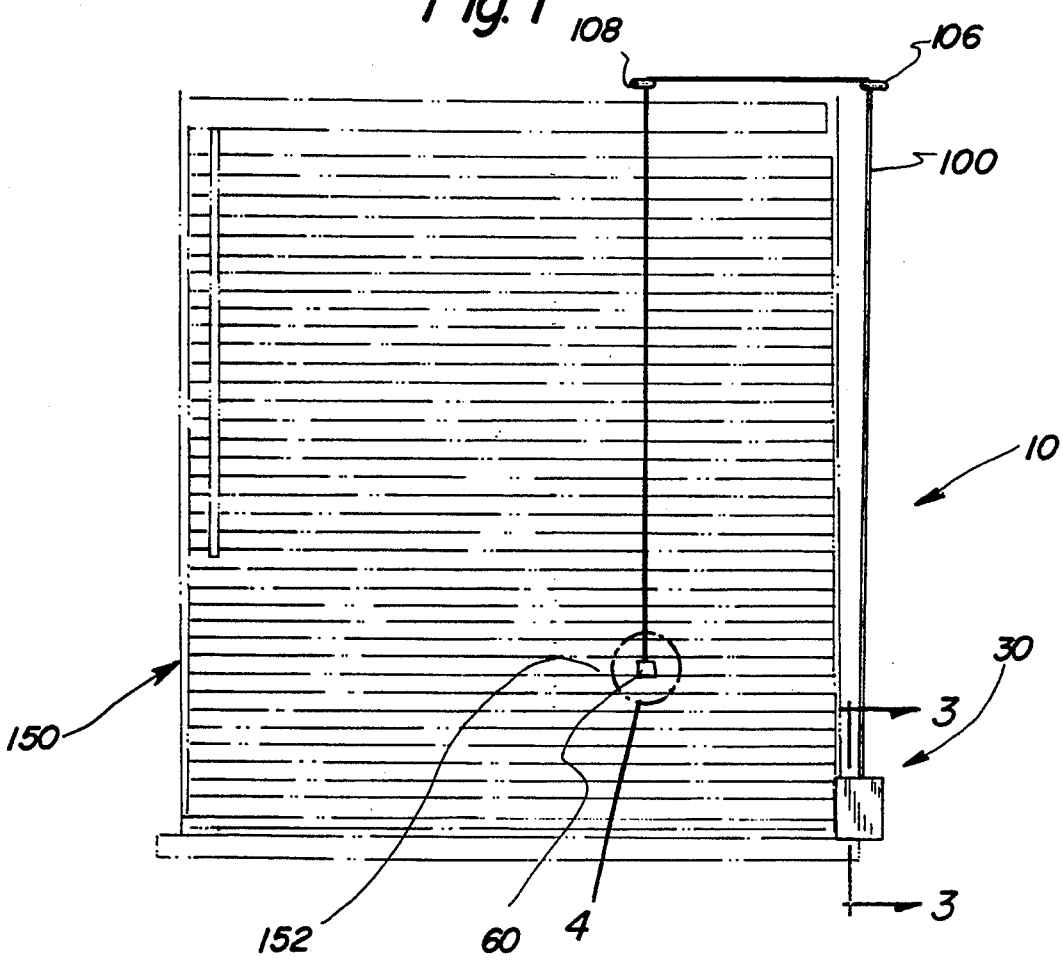
FIG. 1 is a front elevational view of the present invention showing its manner of installation.
Figure 2:
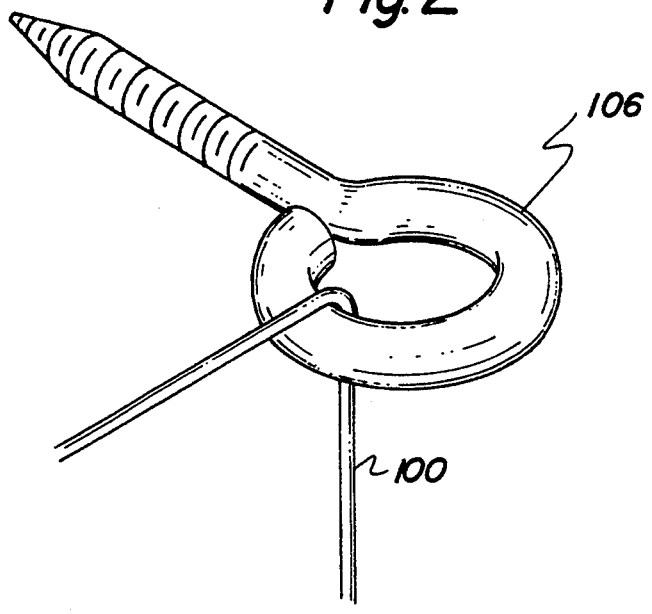
FIG. 2 is a perspective detail view of the invention of FIG. 1 illustrating the manner of operation of one of the cord fairleads.

With reference now to the drawings, and in particular to FIG. 1 thereof, a new and improved security device for controlling window blinds embodying the principles and concepts of the present invention and generally designated by the reference numeral 10 will be described.

From an overview standpoint, the security device for controlling window blinds is adapted for use for automatically periodically lifting and lowering a single slat of a conventional venetian blind or mini blind set to simulate human activity to an observer located outside the window. See FIG. 1.

With reference now to FIGS. 1 through 4 and more specifically, it will be noted that a security device for controlling window blinds 10 by automatically periodically lifting and lowering a single slat 152 of a conventional venetian blind or mini blind set 150 to simulate human activity to an observer located outside the window. The security device for controlling window blinds 10 comprises clip means 60 of transparent rigid material, such as plastic, removedly hookedly connected to the inside of a slat 152 in a tilted-down closed window blind set 150, the clip means 60 having an attachment hole 66 therethrough.

The security device 10 also includes fairlead means 106 and 108, such as a plurality of screw-eyes, fixedly disposed across the top of the window blind 150. Also included is controller means 30 for periodically motivating the blind slat 152. The controller means 30 comprises housing means 32 having a plurality of apertures 34, 36, and 38 extending from the inside to the outside of the housing means 32. The housing means 32 is fixedly mounted to a wall or floor adjacent to the window blind 150.

The controller means 30 further has a battery 46 functionally removedly mounted inside a battery holder 42 within the housing means 32. The controller means 30 has timer means 50, wherefrom an electrical control signal is emitted. The timer control signal has a fixed period and a fixed duration. The timer means 50 is fixedly mounted inside the housing means 32 and is operationally electrically connected to the battery 46.

The controller means 30 additionally incorporates an electrical motor 70 fixedly mounted inside the housing means 32. The electrical motor 70 has a motor shaft 72 extending therefrom. The motor shaft 72 has a spur gear 76 fixedly coaxially coupled thereto. The electrical motor 70 is functionally electrically connected to the battery 46 wherefrom motivating power is derived.

The electrical motor 70 is also functionally electrically connected to the timer means 50 wherefrom control signals are derived whereby the motor 70 is periodically started and stopped, the motor 70 having a mechanical response to the timer control signal such that a single complete revolution of the motor shaft 72 occurs during the duration of one period of the control signal. The controller means 50 moreover includes actuator means 80 whereby rotational motion of the motor shaft 72 is converted to oscillatory linear motion for lifting and lowering the blind slat 152.

The actuator means 80 comprises a drive shaft 82 journalled within the housing means 32, the drive shaft 82 being parallel with the motor shaft 72. The drive shaft 82 has a pinion 84 fixedly coaxially coupled thereto in cooperative relationship with the spur gear 76 of the motor shaft. The drive shaft 82 further has a swivel coupling 88 rotationally eccentrically connected thereto whereby rotation of the drive shaft 82 causes the swivel coupling 88 to orbit the drive shaft 82 whereby the swivel coupling 88 describes a relatively large circular excursion as compared to the excursion of a corresponding point (not shown) on the surface of the drive shaft 82.

The security device 10 additionally includes a cord 100 fixedly connected at one end 102 to the attachment point 66 of the clip means 60. The cord 100 extends generally vertically upwardly through the fairlead means 106 and 108, then horizontally across the top of the window. The cord 100 further extends generally vertically downwardly from the fairlead means 106 and 108, through an aperture 34 of the housing means 32, and is fixedly connected at the free end 104 to the eccentrically operating swivel coupling 88 whereby a linear pulling then relaxing oscillatory motion is imparted to the cord 100 as the swivel coupling 88 revolves around the drive shaft 82.

The linear oscillatory motion of the cord 100 is transferred to the clip means 60, and thence to the blind slat 152, whereby the slat 152 is raised then lowered at a speed determined by the duration of the timer 50 control signal. The repetition rate of each raising and lowering action is determined by the period of the timer 50 control signal.

Figure 3:
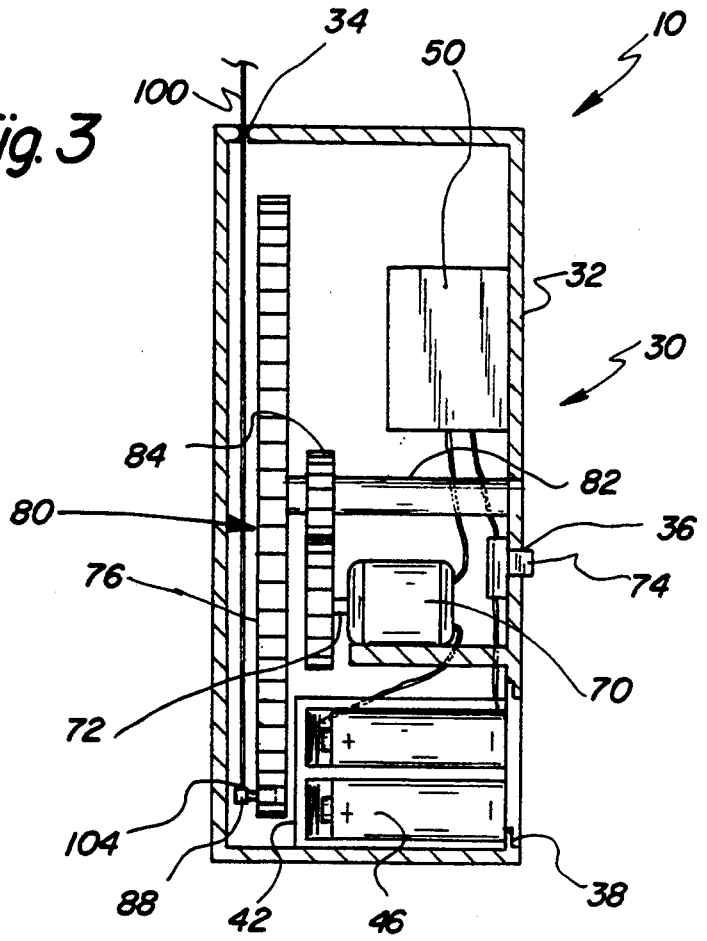
FIG. 3 is a sectional view of the invention of FIG. 1 taken along the line 3—3.
Figure 4:
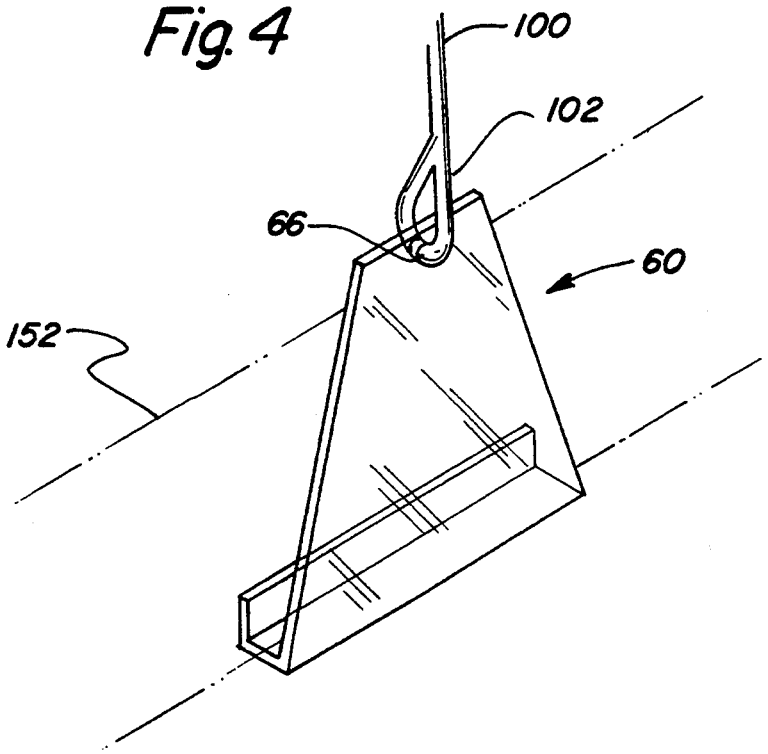
FIG. 4 is a perspective detail view of the invention of FIG. 1 depicting the manner of installation of the slat clip.

Referring specifically to FIG. 3, a first modification of the preferred embodiment of the security device for controlling window blinds 10 is shown wherein the timer means 50 includes switch means 74 fixedly mounted within the housing means 32 whereby a user may change the timer period for reducing the predictability of blind slat manipulation thus increasing credibility of the device.

A second modification of the preferred embodiment of the security device for controlling window blinds 10 further includes a random timer period for improved simulation of a human observer manipulating the blind slat.

Figure 5:
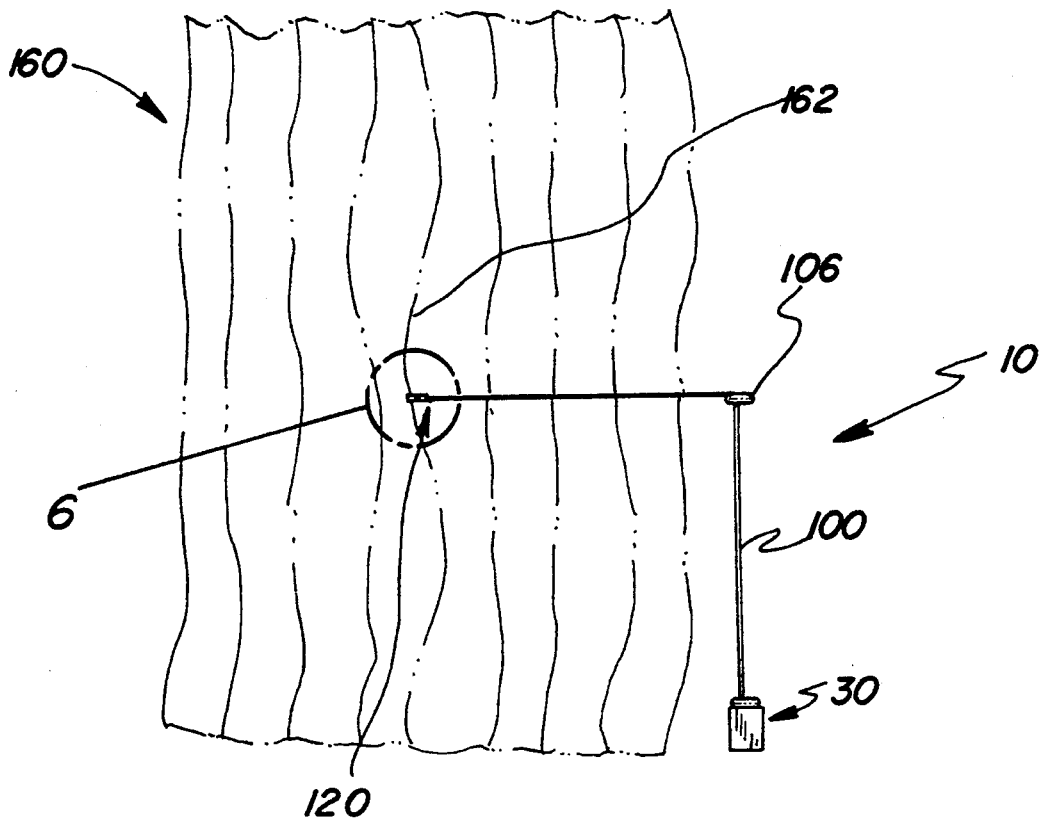
FIG. 5 is a front elevational view of a first modification of the invention of FIG. 1 showing its manner of installation on window curtains.
Figure 6:
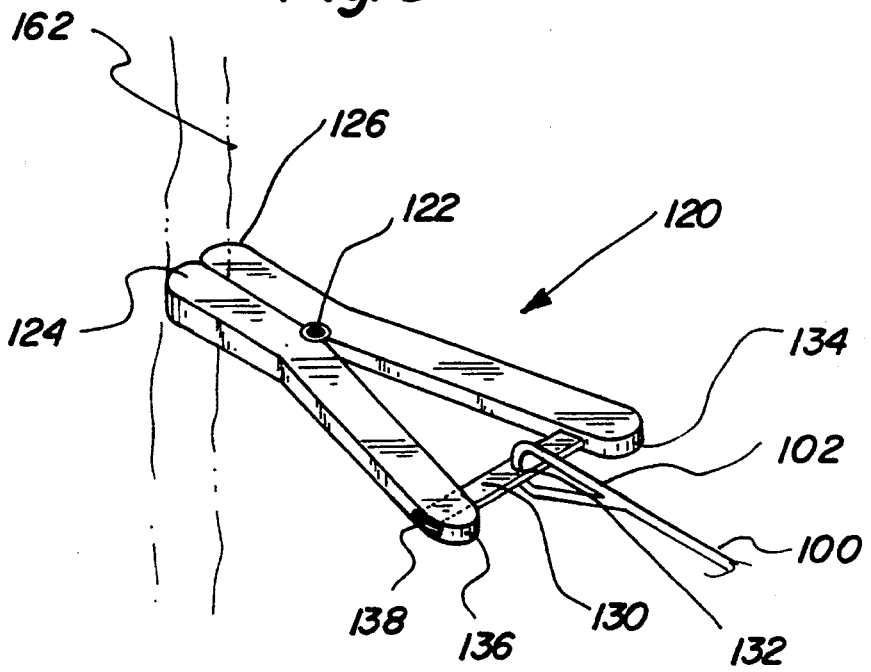
FIG. 6 is a perspective detail view of the invention of FIG. 5 illustrating the manner of installation of the curtain clip.

Yet a third modification of the preferred embodiment of the security device for controlling window blinds 10, shown in FIGS. 5 and 6, replaces the window blind slat clip means 60 with a window curtain clip means 120. The window curtain clip means 120 comprises an identical pair of hinged together opposing jaw elements 124 and 126 biased toward each other, in touching relationship, with a spring 122. The jaw elements 124 and 126 have a fold 162 of the window curtain 160 captured therebetween.

The window curtain clip means 120 also has an identical pair of integral handles 134 and 136 whereby the jaws 124 and 126 may be forced apart. One of the handles 136 has a lateral hole 138 therethrough. The handles 134 and 136 have a bar member 130 extending therebetween, the bar member being fixedly connected at one end to one of the handles 134 and slidably disposed through the hole 138 of the other handle 136. The bar having a lateral attaching hole 132 therethrough wherethrough the end of the cord 102 is fixedly connected.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention. In as much as the present disclosure includes that contained in the appended claims as well as that of the foregoing description. Although this invention has been described in its preferred forms with a certain degree of particularity, it is understood that the present disclosure of the preferred form has been made only by way of example and numerous changes in the details of construction and combination and arrangement of parts may be resorted to without departing from the spirit and scope of the invention.

Now that the invention has been described,

What is claimed is:

1. A new and improved security device for controlling window blinds by automatically periodically lifting and lowering a single slat of a conventional blind set to simulate human activity to an observer located outside the window, the security device for controlling window blinds comprising:

clip means of transparent rigid material such as plastic removedly hookedly connected to the inside of a slat in a tilted-down closed window blind set, the slat being of the type having an inside and an outside, the clip means having an attachment point;

fairlead means formed as a plurality of screw-eyes fixedly disposed across the top of the window blind;

controller means for periodically motivating the blind slat, the controller means comprising:

housing means having a plurality of apertures extending from the inside to the outside of the housing, the housing means being fixedly mounted to a surface adjacent to the window blind;

electrical energy source means formed as a battery functionally removedly mounted inside the housing means;

timer means wherefrom an electrical control signal is emitted from time to time, the control signal having a fixed period, the control signal also having a fixed duration, the timer means fixedly mounted inside the housing means, the timer means also being operationally electrically connected to the electrical energy source means;

an electrical motor fixedly mounted inside the housing means, the electrical motor having a motor shaft extending therefrom, the motor shaft having drive coupling means formed as a spur gear fixedly coaxially coupled thereto, the electrical motor being functionally electrically connected to the energy source means wherefrom motivating power is derived, the electrical motor also being functionally electrically connected to the timer means wherefrom control signals are derived whereby the motor is periodically started and stopped, the motor having a mechanical response to the timer control signal such that a single complete revolution of the motor shaft occurs during the duration of one period of the control signal;

actuator means whereby rotational motion of the motor shaft is converted to oscillatory linear motion to lift and lower the blind slat, the actuator means comprising:

a drive shaft journalled within the housing means, the drive shaft being parallel with the motor shaft, the drive shaft having drive coupling means such as a pinion fixedly coaxially coupled thereto in cooperative relationship with the drive coupling means of the motor shaft, the drive shaft further having a swivel coupling rotationally eccentrically connected thereto whereby rotation of the drive shaft causes the swivel coupling to orbit the drive shaft whereby the swivel coupling describes a relatively large circular excursion as compared to the excursion of a corresponding point on the surface of the drive shaft; and a cord fixedly connected at one end to the attachment point of the clip means, the cord extending generally vertically upwardly through the fairlead means then horizontally across the top of the window, the cord additionally extending generally vertically downwardly from the fairlead means through an aperture of the housing means, the cord further being fixedly connected at the free end to the eccentrically operating swivel coupling whereby a linear pulling then relaxing oscillatory motion is imparted to the cord as the swivel coupling revolves around the drive shaft, the linear oscillatory motion of the cord being transferred to the clip means and thence to the blind slat whereby the slat is raised then lowered at a speed determined by the duration of the timer control signal, the repetition rate of each raising and lowering action being determined by the period of the timer control signal.

2. The security device for controlling window blinds of claim 1 wherein the timer means includes switch means whereby a user may change the timer period for reducing the predictability of blind slat manipulation thus increasing credibility of the device.

3. The security device for controlling window blinds of claim 2 and further including a random timer period for improved simulation of a human observer manipulating the blind slat.

4. The security device for controlling window blinds of claim 1 wherein the clip means is a window curtain clip means, the window curtain clip means comprising:

an identical pair of hinged together opposing jaw elements biased closed wherebetween a fold of the window curtain may be captured;

an identical pair of integral handles whereby the jaws may be forced open; and an attachment point having the end of the cord fixedly connected thereto.

5. A new and improved security device for controlling window blinds by automatically periodically lifting and lowering a single slat of a conventional blind set with a plurality of coupled slats to simulate human activity to an observer located outside the window, the security device for controlling window blinds comprising:

a motor-driven pull-cord directly connected to one single slat of a window blind set;

means for controlling said cord drive motor whereby a frequency and duration of pull-cord and slat movement is established; and fairlead means whereby the pull-cord is routed from the window slat to the cord drive motor.

* * * * *